US010258119B2

(12) United States Patent
Cox et al.

(10) Patent No.: US 10,258,119 B2
(45) Date of Patent: Apr. 16, 2019

(54) CANE WITH LED LIGHTS

(71) Applicants: Kathleen Cox, Katy, TX (US); Thomas Cox, Katy, TX (US)

(72) Inventors: Kathleen Cox, Katy, TX (US); Thomas Cox, Katy, TX (US)

( * ) Notice: Subject to any disclaimer, the term of this patent is extended or adjusted under 35 U.S.C. 154(b) by 0 days.

(21) Appl. No.: 15/598,025

(22) Filed: May 17, 2017

(65) Prior Publication Data

US 2018/0332934 A1 Nov. 22, 2018

(51) Int. Cl.

| | |
|---|---|
| ***A45B 3/04*** | (2006.01) |
| ***F21S 9/02*** | (2006.01) |
| ***F21V 33/00*** | (2006.01) |
| ***F21V 23/04*** | (2006.01) |
| ***F21V 23/02*** | (2006.01) |
| ***A45B 9/02*** | (2006.01) |
| *F21Y 115/10* | (2016.01) |
| *F21Y 113/13* | (2016.01) |
| *A45B 9/00* | (2006.01) |

(52) U.S. Cl.

CPC ..... *A45B 3/04* (2013.01); *A45B 9/02* (2013.01); *F21S 9/02* (2013.01); *F21V 23/023* (2013.01); *F21V 23/04* (2013.01); *F21V 33/0004* (2013.01); *A45B 2009/002* (2013.01); *F21Y 2113/13* (2016.08); *F21Y 2115/10* (2016.08)

(58) Field of Classification Search

CPC .... H01H 9/182; H01H 3/08; H01H 2219/062; H01H 2221/01; G02B 6/0068; G02B 6/0076; G05G 1/08; A45B 3/04; A45B 9/02; A45B 2009/002; F21V 23/023; F21V 23/04; F21V 33/0004; F21S 9/02; F21Y 2113/13; F21Y 2115/10

See application file for complete search history.

(56) References Cited

U.S. PATENT DOCUMENTS

| | | | | |
|---|---|---|---|---|
| 4,527,824 | A * | 7/1985 | Rosenfeld | A45B 3/00 135/66 |
| 7,395,629 | B1 * | 7/2008 | Thomas | A01K 77/00 43/11 |
| 2005/0103373 | A1 * | 5/2005 | Heiss | A45B 9/00 135/100 |
| 2010/0232175 | A1 * | 9/2010 | Ho | B60Q 1/26 362/551 |
| 2011/0074300 | A1 * | 3/2011 | Hsu | H05B 33/0821 315/185 S |
| 2012/0281391 | A1 * | 11/2012 | Bort | G09F 27/007 362/183 |
| 2014/0170589 | A1 * | 6/2014 | Huang | A61C 1/088 433/29 |
| 2014/0261590 | A1 * | 9/2014 | Riemer | A45B 3/04 135/66 |

* cited by examiner

*Primary Examiner* — Anh T Mai
*Assistant Examiner* — Glenn D Zimmerman
(74) *Attorney, Agent, or Firm* — Furr Law Firm; Jeffrey Furr, Esq.

(57) ABSTRACT

The current invention is an LED-lighted walking-cane. It is a fixed-height cane, with a string of LED lights coiled along the entire length. The user turns the lights on and off with a switch on the handle. The lights are battery-powered. The battery pack is stored in a cavity within the cane.

6 Claims, 6 Drawing Sheets

CANE WITH LED LIGHTS

CROSS-REFERENCES TO RELATED APPLICATIONS (IF ANY)

None.

BACKGROUND

1. Field of the Invention

This invention relates to walking canes and particularly ones that have lights.

2. Description of Prior Art

Mobility aids, such as canes, are used by many people to get around. Individuals may use mobility aids are used by aging individuals, those with permanent disabilities, and for temporary support following injury or illness. Each year, people are injured when a mobility aid hits an obstacle or strikes a slick surface that they just cannot see.

There is still room for improvement in the art.

SUMMARY OF THE INVENTION

The current invention is a lighted walking cane. A standard, fixed-height cane has a coil of LED lights from top to bottom, with a switch.

The cane is a fixed height. An LED light cord is coiled around the cane. The light cords are held the cane by tubular shrink-wrap. The battery pack is in a cavity within the cane, with a hinged cover. The lights are activated by a switch.

This is an improvement over existing art.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

There are a number of significant design features and improvements incorporated within the invention.

Figure 1:
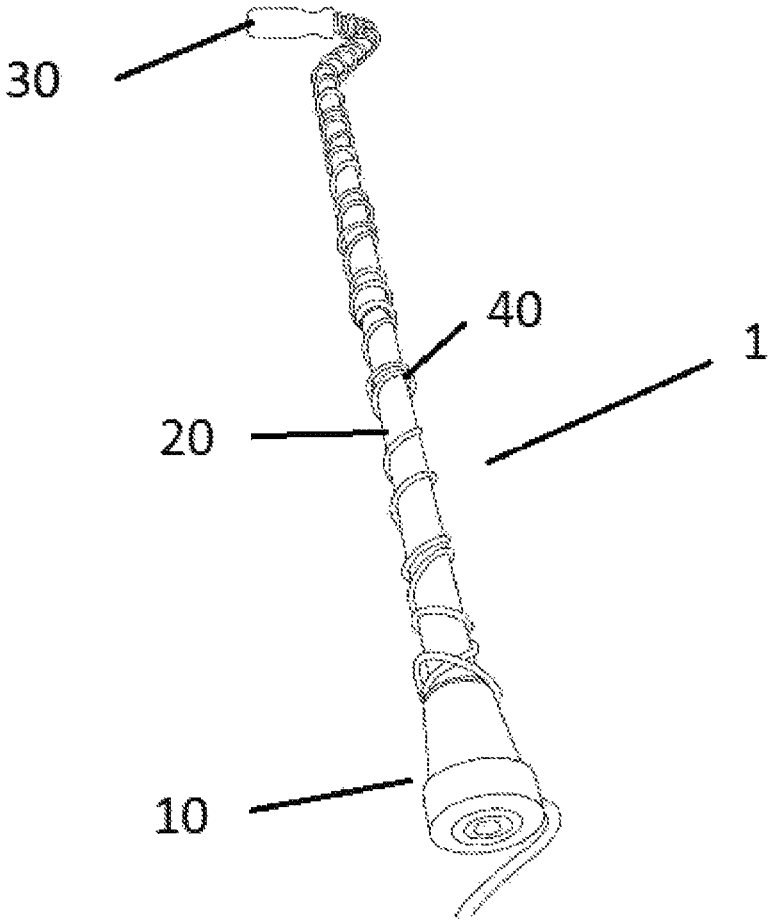
FIG. 1 shows the cane from below.
Figure 2:
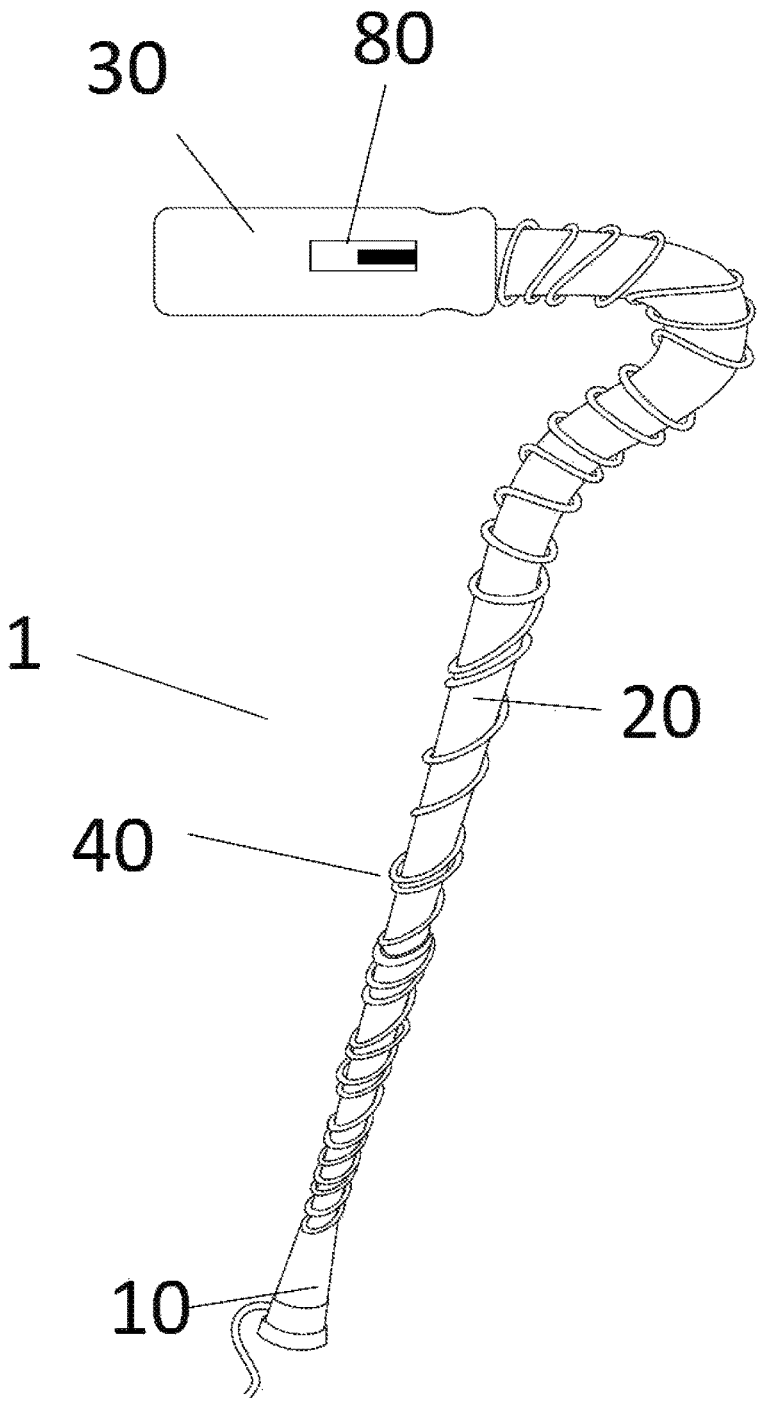
FIG. 2 shows the cane from above.
Figure 3:
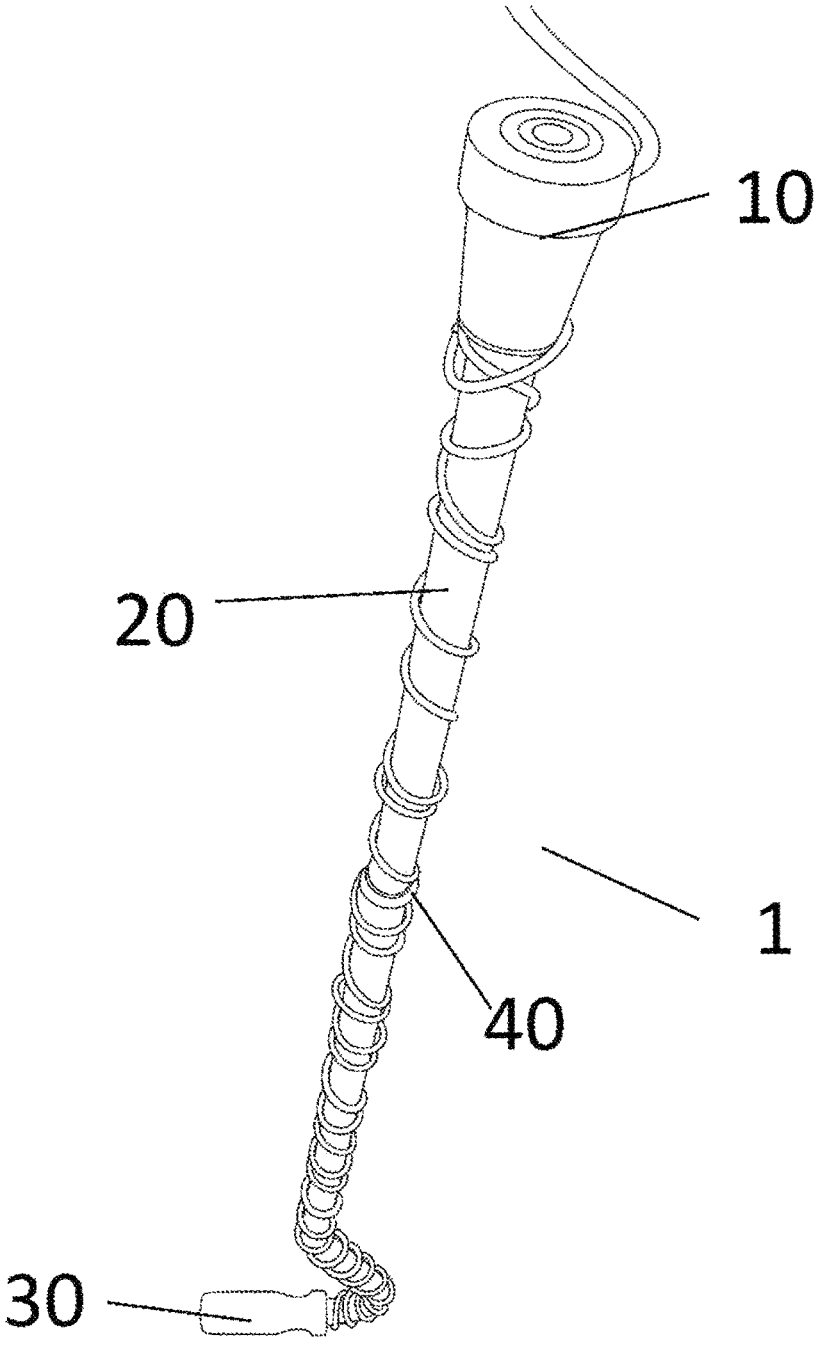
FIG. 3 shows the cane from another below angle.
Figure 4:
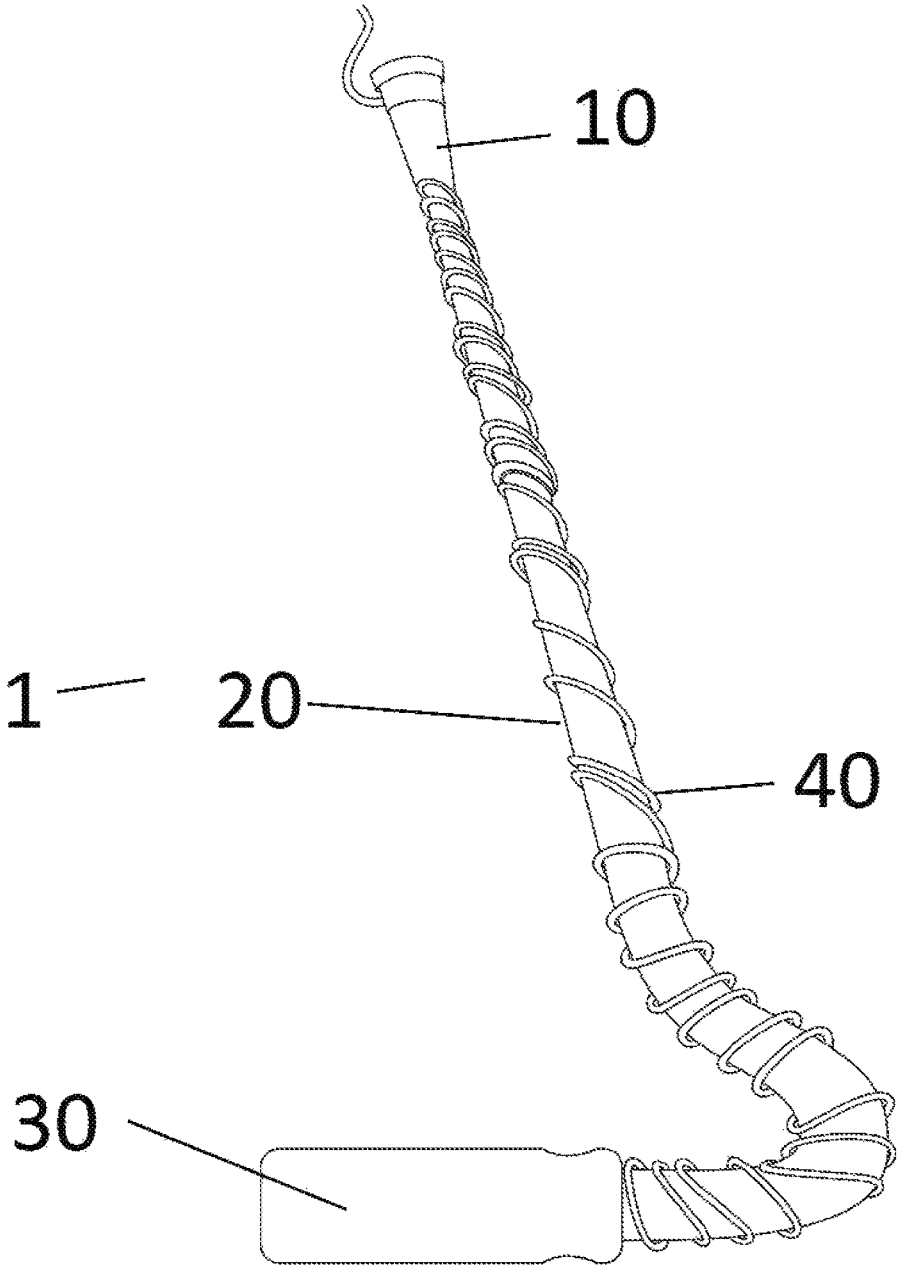
FIG. 4 shows another view of the cane.
Figure 5:
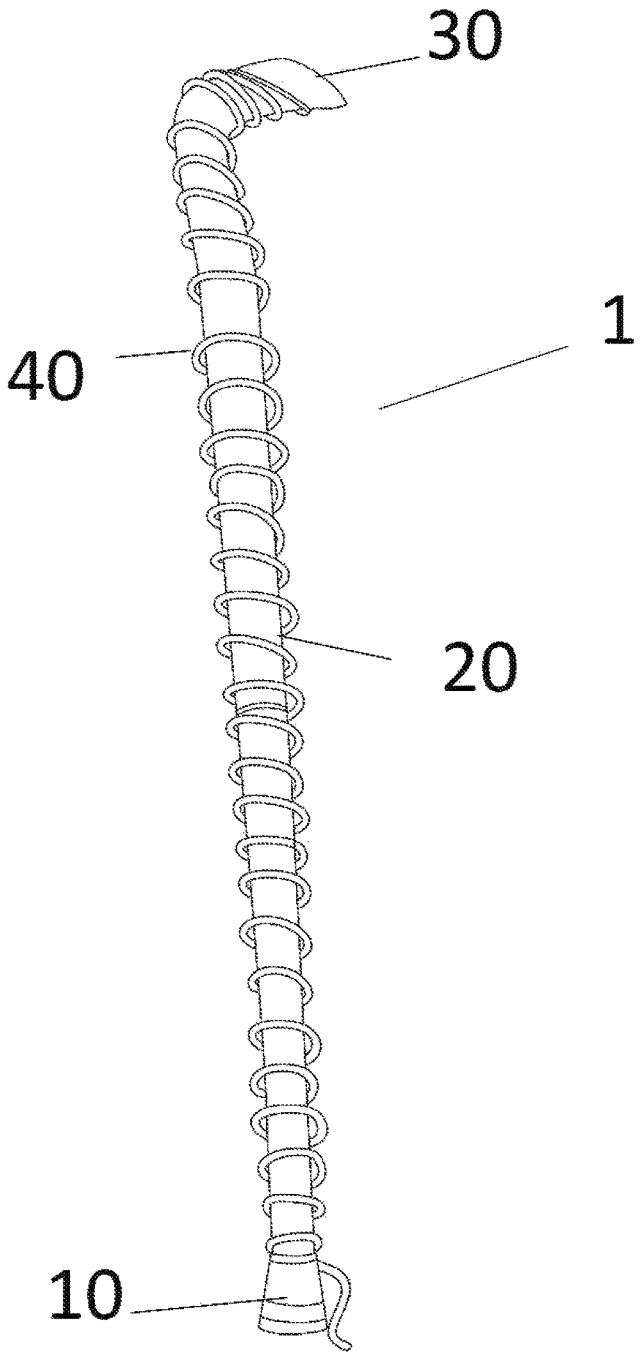
FIG. 5 shows another view of the cane.
Figure 6:
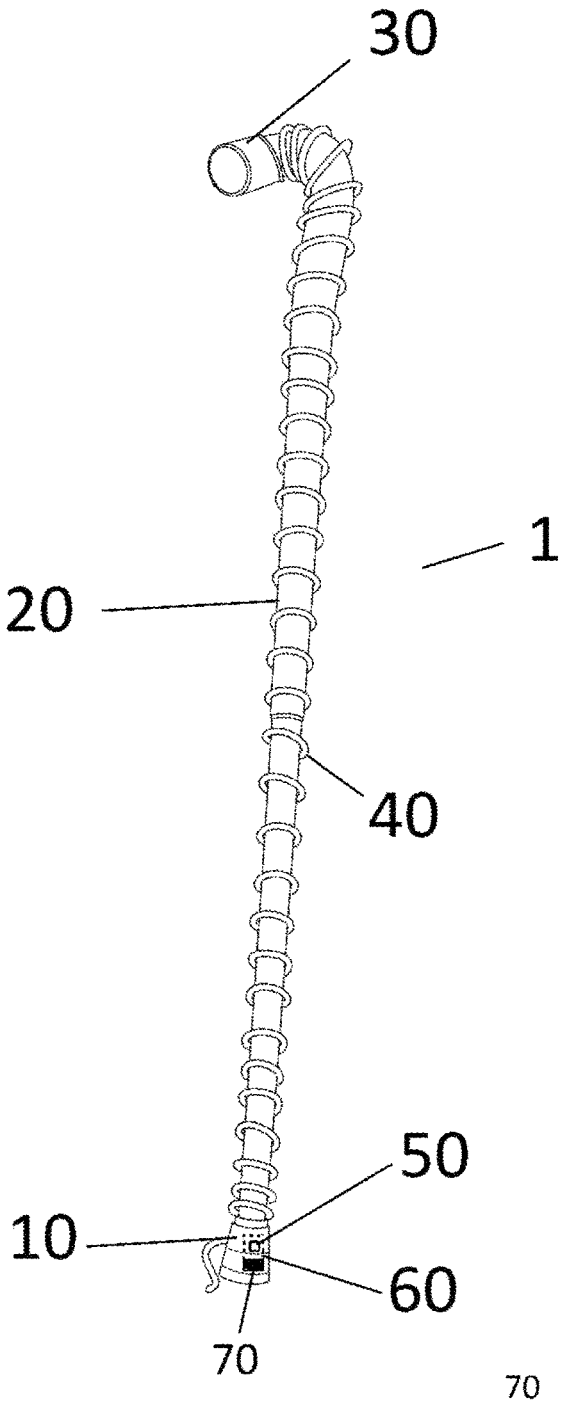
FIG. 6 shows another view of the cane.

As shown in FIGS. 1 through 6, the current invention is a lighted walking cane 1. A standard, fixed-height cane has a set of LED lights 40 from top to bottom, with a switch that the handle. In the preferred embodiment, the LED lights 40 would be in a coil of LED lights The cane 1 is a fixed height with a straight stick part 20 with two ends, a bottom end and a top end. A tip 10 is on the bottom end. The tip 10 will be made of a soft, grip able material as it will make contact with the floor or ground. A handle 30 is attached to the top end. Any standard handle can be used like one that extends 90 degrees for the stick part 20 and cover with a soft, grip able material like rubber or plastic.

An LED light source like an LED cord 40 is coiled around the cane 1 mainly around the stick 20 portion. The light cords are held the cane by tubular shrink-wrap, although other means can be used. Multiple LED cords 40 may be used and the LED cords can have one or more different colors or colored lights.

The LED lights are powered by a power source like a battery pack 50. In the preferred embodiment, the battery pack 50 is in a cavity 60 within the cane, with a hinged cover 70. The lights are activated by a switch 80 located below the handle 30 or at the bottom of the cane 1.

Advantages

The innovative lighted canes allow a user to see where they are going, without a blinding light. Other lighted-mobility aids, and most lighting accessories, have bright directional lighting. This lighted cane has lighting going in all directions, without the bright intensity.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

That which is claimed is:

1. A cane comprising:
a stick portion with a top and bottom with a handle attached to the top and a tip attached to the bottom with a plurality of LED lights coiled around the cane having the plurality of LED lights held by tubular shrink-wrap with an on and off switch on the bottom of the cane where the plurality of LED lights are powered by a battery pack located within a cavity in a cavity in the cane that is covered by a hinged cover.

2. The cane according to claim 1 comprising:
having each LED be a coil of LED lights.

3. The cane according to claim 1 comprising:
having each LED be two or more different colors.

4. The cane according to claim 1 comprising:
where the tip is comprised of a soft, grip able material.

5. The cane according to claim 1 comprising:
where the handle extends 90 degrees for the stick portion.

6. The cane according to claim 1 comprising:
where the handle is covered with a soft, grip able material.

* * * * *